United States Patent [19]

Yeager

[11] Patent Number: 4,833,461

[45] Date of Patent: May 23, 1989

[54] UTILITY SHUT OFF APPARATUS

[76] Inventor: Richard Yeager, 1439 Inge Ct., Sacramento, Calif. 95864

[21] Appl. No.: 150,765

[22] Filed: Feb. 1, 1988

[51] Int. Cl.[4] ..... G08B 21/00; H01H 47/00

[52] U.S. Cl. ..... 340/690; 137/38; 307/117; 361/170

[58] Field of Search ..... 340/690, 636; 200/61.45 R; 361/170; 307/117, 121, 23, 64; 137/38–39; 251/74; 431/78

[56] References Cited

U.S. PATENT DOCUMENTS

| | | | |
|---|---|---|---|
| 4,098,284 | 7/1978 | Yamada | 137/39 |
| 4,180,088 | 12/1979 | Mallett | 137/87 |
| 4,390,922 | 6/1983 | Pelliccia | 361/170 |
| 4,414,994 | 11/1983 | Hogan | 137/38 |
| 4,556,799 | 12/1985 | Rolando | 250/577 |

*Primary Examiner*—Glen R. Swann, III
*Assistant Examiner*—Thomas J. Mullen, Jr.
*Attorney, Agent, or Firm*—Mark C. Jacobs

[57] ABSTRACT

Apparatus for shutting off utilities, such as gas and electricity, automatically in the case of an emergency, such as an earthquake. The utility can be a gas or electric line and, at shutdown, an alarm may be sounded and a light activated. The apparatus includes a box mounted adjacent the main power panel. The box includes a solenoid wired to the main breaker switch of the main power panel and a start/stop switch coupled to the solenoid valve at the main gas line. If an earthquake hits, the solenoid to the electric panel is activated to shut off the main switch. This in turn activates the solenoid to the gas line which turns off the gas. Simultaneously, a signal alarm coupled to the box sounds and a light also coupled to the box is lit. The alarm may be turned off manually and the light kept on, if desired. After the emergency, the control panel may be reset and the gas turned on after manually opening the gas valve and re-lighting the pilot. Power to the box may be provided by coupling the same to the main power panel. Optionally, the apparatus may also be used to shut off the main water line.

9 Claims, 1 Drawing Sheet

UTILITY SHUT OFF APPARATUS

BACKGROUND OF THE INVENTION

1. Field of the Invention

The invention relates to earthquake emergency apparatus; and, more particularly, to apparatus for automatically shutting off the electricity and gas in case of an earthquake or other emergency.

2. Description of the Prior Art

In case of earthquakes, gas lines may rupture and may be ignited and cause explosions and fires. Most survival guides advise that one keep on hand pipe wrenches and crescent wrenches to turn off the gas and water and one should known where one's main shutoffs for electricity are so that the main switch may be shut off to turn off the electricity since short circuits may ignite escaping gas and cause fires and explosions. However, one may not have a light available to shut off the water and gas should electric power be cut off. Also, if an earthquake hits and the electricity stays on, the homeowner may be more concerned with evacuation and safety and not be interested in shutting off the gas, water and electricity. Further, the homeowner may not be physically or emotionally able to shut off the gas, water and electricity.

There thus exists a need for an automatic utility shut off in case of earthquakes or other emergencies.

SUMMARY OF THE INVENTION

It is an object of this invention to provide an automatic utility shut off for shutting off gas, electiricty and/or water in case of an earthquake or other emergency.

It is a further object of this invention to provide such as shut off having a built in alarm and light.

These and other objects are preferably accomplished by providing a box mounted adjacent the main power panel. The box includes a solenoid wired to the main breaker switch of the main power panel and a start/stop switch coupled to a solenoid coupled to the shut off valve at the main gas line. If an earthquake hits, the solenoid to the electric panel is activated to shut off the main switch. This in turn activates the solenoid at the gas line to turn off the gas. Simultaneously, a signal alarm coupled to the box sounds and a light also coupled to the box lights. The alarm may be turned off manually and the light kept on, if desired. After the emergency, the control panel may be reset and the gas turned on after manually opening the gas valve and re-lighting the pilot. Power to the box may be provided by coupling the same to the main power panel. Optionally, the apparatus may also be used to shut off the main water line.

DESCRIPTION OF THE PREFERRED EMBODIMENT

Figure 1:
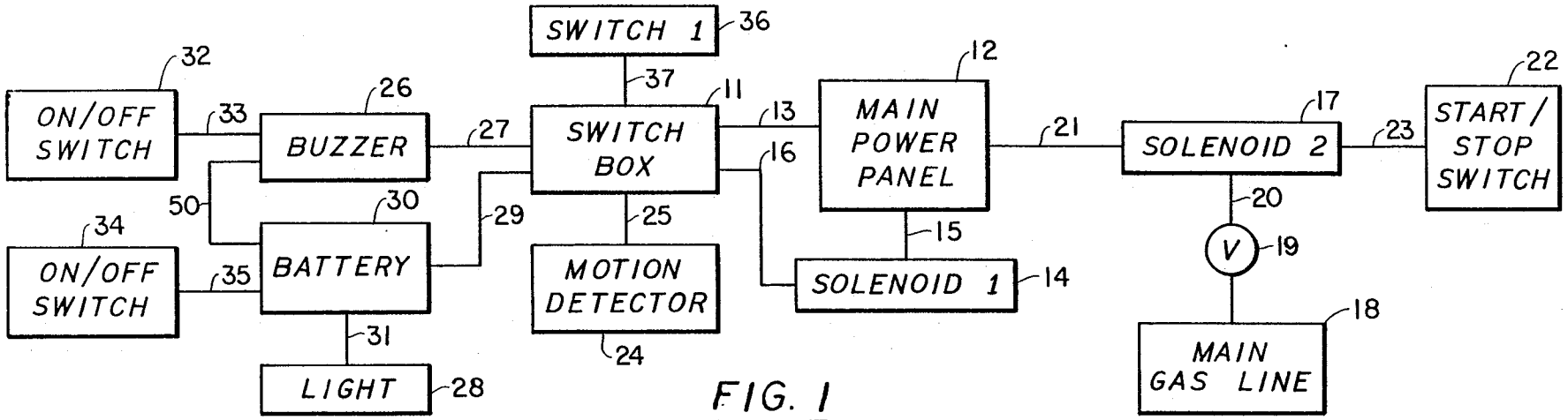
FIG. 1 is a schematic illustration of apparatus for emergency shut off of utilities, as gas and electricity.

Referring now to FIG. 1 of the drawing, apparatus 10 is illustrated schematically for emergency shut off of gas and electricity. Apparatus 10 includes a switch box 11 which may be mounted on a wall or the like or otherwise is located adjacent a main power control panel 12 of a house or the like. Switch box 11 is wired via conduit 13 to a source of power in panel 12, such as a 110 volt outlet. A first solenoid 14, labeled Solenoid 1 in FIG. 1, is coupled via conduit 15 to the main shut-off switch internally mounted in panel 12. Solenoid 14 may be mounted at any convenient location adjacent panel 12 or be part of box 11. In either case, solenoid 14 is electronically coupled to switch box 11 via conduit 16.

A second solenoid 17, labeled Solenoid 2 and which may also be a part of box 11, or may be located adjacent the main gas line 18 located at the house's gas meter, is coupled to the main gas shut off valve 19 via line 20. Conduit 21 couples solenoid 17 to suitable electrical controls interiorly of box 12 for providing power to solenoid 17. Conduit 21 is wired to the main control panel 12 so that solenoid 17 shuts off to close gas line valve 19 when the main power at panel 12 is turned off. A start/stop switch 22 may be provided electronically coupled via conduit 23 to solenoid 17 to reset the same.

A conventional motion detector 24, which may be adjusted to the sensitivity desired, is coupled to switch box 11 via conduit 25. A conventional buzzer 26 is provided either interiorly of box 11 or separate therefrom, electrically coupled thereto via conduit 27 for audibly sounding a signal. An on/off switch 32 is coupled to buzzer 26 via conduit 33 to turn buzzer 26 on or off as desired. Buzzer 26 is normally inactivated when the main power at panel 12 is on. An auxiliary light 28 is also provided and is normally off when the main power at panel 12 is on. Light 28 is coupled to a portable battery 30 via conduit 31 which is activated via conduit 29 to box 11 when the main power at panel 12 is shut off. A reset switch 36 is provided internally of box 11 or coupled thereto via conduit 37 for resetting the same after actuation by motion detector 24. A second on/off switch is electrically connected by conduit 35 to battery to shut off light 28 manually, or turn it back on as needed, may be included.

In operation, if an earthquake hits, motion detector 24 activates the circuit inside of switch box 11 to trip solenoid 14 via conduit 16 which in turn shuts off the main breaker switch inside of panel 12, via conduit 15, which sends a signal, via conduit 21, to solenoid 17 to shut off gas valve 19 thus turning off the gas. Simultaneously, buzzer 26 and battery 30 are activated and light 28 is turned on. Switch 32 may be activated, if desired, to turn off buzzer 26. Optional switch 34 may also be provided coupled to battery 30 via conduit 35 to shut off light 28, if desired. Normally, light 28 would be left on particularly at night time so that residents can safely evacuate the house. Buzzer 26 may be any suitable manual device or power thereto may be provided via conduit 50 coupling buzzer 26 to battery 30.

After the earthquake is over and it is determined that the emergency has passed, before power and gas is restored, the homeowner should inspect the electric and gas lines to ensure that there has been no physical damage. When safe to do so, the homeowner would go to panel 12 and switch on the main switch. The gas will not come on automatically; however, power is now on. The homeowner should check his house lights for any shorts in the system. Assuming everything is in order, the homeowner would go to the gas meter adjacent gas line 18 and push or otherwise activate the start portion of start/stop switch 22 to re-set solenoid 17 to turn on valve 19. The gas is now on; however, the pilot must be re-lit. The switch box 11 can now be turned on to be reset for the next earthquake.

The start/stop switch 22 at the gas valve 19 acts as a safety feature so that, if there is a power failure and no one is at home, when the lights come back on, the gas will not. If this werenot so, gas fumes would be present from the pilot. The start button of switch 22 will have to be pushed to the on position and the pilot relit.

Of course, the homeowner may want to check with his local utility companies before resetting apparatus 10.

Figure 2:
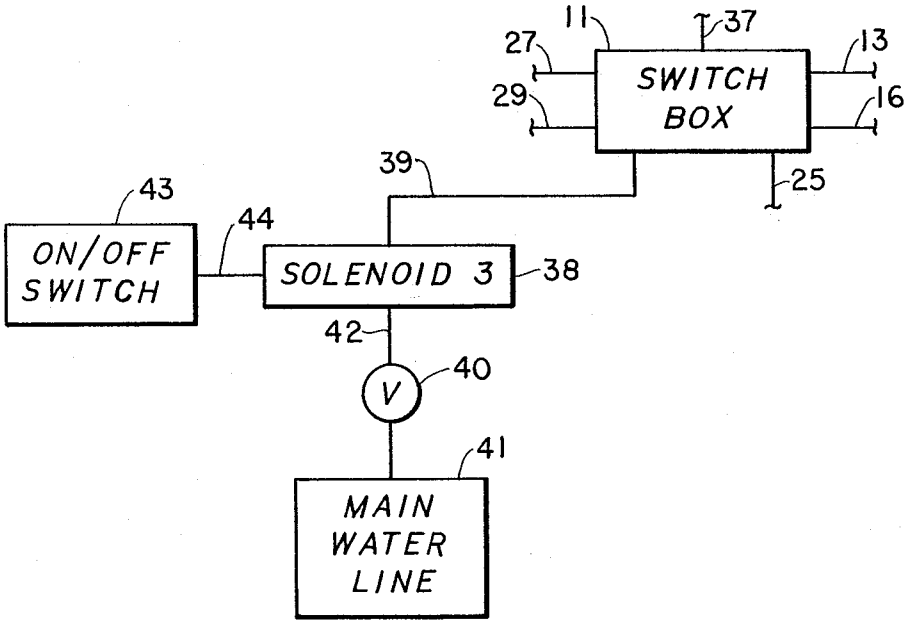
FIG. 2 is a schematic illustration of a portion of the drawing of FIG. 1 adding a water shut off.

Although the apparatus 10 in FIG. 1 is described with respect to gas and electricity, in some municipalities it is also recommended that the water be shut off in the case of an earthquake or other emergency to avoid broken lines in the house. This can be easily added to the apparatus 10 of FIG. 1. Thus, as seen in FIG. 2 wherein like numerals refer to like parts of the apparatus of FIG. 1, portions thereof being omitted for convenience of illustration, a third solenoid 38, labeled Solenoid 3, may be coupled to box 11 via conduit 39. The main valve 40 of water line 41 is coupled, via conduit 42, to solenoid 38 and activated to automatically shut off valve 40 upon actuation via motion detector 24 in case of an earthquake. A manual on/off switch 43 may be coupled to solenoid 38 via conduit 44 to reset the same.

Although the invention has been described with respect to an earthquake, obviously it has applications in other emergencies, such as fire, war, etc. In the event of a major earthquake, many lives would be saved since fires, gas fumes and explosions from shorting electrical wires and breaking or ruptured gas lines are avoided using the teachings of the invention herein. The light and buzzer being activated will alert the homeowner who may be asleep when an earthquake hits to a possible emergency situation.

Any suitable materials may be used. For example, battery 30 may be a conventional 6 volt battery. The various boxes may be NEMA-type boxes. Obviously, various components may be integrated where possible. For example, a main housing may be used integrating motion detector 24, light 28, switch box 11, battery 30, buzzer 26, solenoids 14, 17, switches 36, 34, 32, etc. Suitable relays and up-to-date electronic components may be used. A suitable motion detector is manufactured by ANES Electronics Co. Model VI, 12 volt. A suitable gas valve is manufacturd by ASCO.

It can be seen that there is described a quick and easy utility shut off for shutting off gas and electricity in case of an emergency or the like. Although I have described a particular arrangement of parts and components, the scope of the invention should be determined by the scope of the appended claims.

Figure 3:
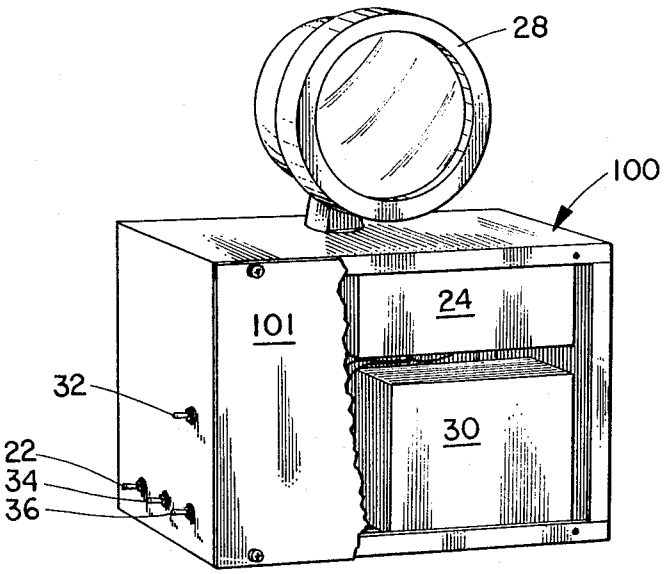
FIG. 3 is a perspective view of a device encompassing the apparatus of this invention.

Reference should now be made to FIG. 3 which is a perspective view of a device embodying the instant invention. Thus box 100, a typical NEMA 3R type box is seen. Sealed beam light 28 as well as the battery 30 and charging system made by Lithonia and are representative of available products. The motion detector 24, made by Anes Electronics Inc., and the battery 30 for the light are readily visible. The main on/off switch 32, as well as the switches 22, 34 and 36 are seen. The remaining components are either behind front wall 101 of box 100, or are not shown in this exemplary figure.

In the discussions above solenoid 17 is recited as a discrete component. It can be an integral part of valve 19. The same is true with other components, that are recited separately. Two or more are often commercially available as an integrated unit. While conduit is recited, in many instances, mere wiring will suffice, especially with the NEMA box.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. Apparatus for shutting off utilities in case of an emergency, such as an earthquake, adapted to be coupled to the main power panel of a house comprising:

a motion detector;

a switch box electroncally coupled to said detector;

first solenoid means electronically coupled to said box adapted to be mechanically coupled to the main switch of said power panel for shutting off the same, upon detection of movement by said motion detector; and second solenoid means electronically coupled to said panel and also coupled to a shut off valve associated with the main gas line of the house to terminate gas flow upon cessation of power, and further including, a start and stop switch coupled to the gas valve for resetting the gas flow.

2. In the apparatus of claim 1 including a reset switch coupled to said box for resetting the same upon tripping of said first solenoid after detection of movement by said motion detector.

3. In the apparatus of claim 1 including an audible buzzer electronically coupled to said box and normally inactivated when power is supplied to said box from said main power panel.

4. In the apparatus of claim 3 including an on/off switch coupled to said buzzer for selectively turning said buzzer on and off.

5. In the apparatus of claim 1 or 3 including a battery operated light electronically coupled to said box, said light being normally inactivated when power is supplied to said box from said main power panel.

6. In the apparatus of claim 5 including an on/off switch coupled to a battery coupled to said light for operating the same.

7. In the apparatus of claim 6 wherein said battery is also electronically coupled to a buzzer.

8. In the apparatus of claim 1 including third solenoid means electronically coupled to said box adapted to be coupled to a shut off valve for the main water supply to said house for shutting off the water upon detection of movement by said motion detector.

9. In the apparatus of claim 8 including an on/off switch coupled to said third solenoid means for resetting the same after tripping of said third solenoid means upon detection of movement by said motion detector.

* * * * *